United States Patent [19]

Aono et al.

[11] Patent Number: 4,818,662

[45] Date of Patent: Apr. 4, 1989

[54] PROCESS FOR FORMING COLOR IMAGES

[75] Inventors: Toshiaki Aono; Koichi Nakamura, both of Kanagawa, Japan

[73] Assignee: Fuji Photo Film Co., Ltd., Kanagawa, Japan

[21] Appl. No.: 18,859

[22] Filed: Feb. 25, 1987

Related U.S. Application Data

[63] Continuation of Ser. No. 811,321, Dec. 19, 1985, abandoned, which is a continuation of Ser. No. 594,050, Mar. 28, 1984, abandoned.

[30] Foreign Application Priority Data

Mar. 30, 1983 [JP] Japan ..... 58-54169

[51] Int. Cl.[4] ..... G03C 5/54; G03C 1/06

[52] U.S. Cl. ..... 430/348; 430/203; 430/215; 430/265

[58] Field of Search ..... 430/215, 203, 265, 348

[56] References Cited

U.S. PATENT DOCUMENTS 3,409,430 11/1968 Limberger ..... 430/232

4,268,601 5/1981 Namiki et al. ..... 430/263 X

FOREIGN PATENT DOCUMENTS 1181548 11/1964 Fed. Rep. of Germany .

2100458 12/1982 United Kingdom ..... 430/203

*Primary Examiner*—Mukund J. Shah

*Attorney, Agent, or Firm*—Sughrue, Mion, Zinn, Macpeak, and Seas

[57] ABSTRACT

A process for forming a color image comprising exposing and heating a light-sensitive material comprising a support having thereon a light-sensitive silver halide, a binder and a compound capable of forming or releasing a mobile dye chemically in connection with reduction of the silver halide into silver upon heating, transferring and fixing the thus formed or released mobile dye to a dye fixing layer, and then separating the portion having the silver halide and the compound capable of forming or releasing a mobile dye and the portion having the dye fixing layer from each other, and wherein polyvinyl alcohol is present in at least one surface layer of the light-sensitive material and the dye fixing layer being separated is disclosed.

11 Claims, No Drawings

PROCESS FOR FORMING COLOR IMAGES

This is a continuation of application Ser. No. 811,321, filed Dec. 19, 1985, now abandoned, which is a continuation of application Ser. No. 594,050, filed Mar. 28, 1984, now abandoned.

FIELD OF THE INVENTION

This invention relates to a novel process for forming a color image by heating a heat-developable light-sensitive material in a substantially water-free condition.

This invention further relates to a novel light-sensitive material containing a dye-releasing redox compound capable of releasing a hydrophilic dye upon reaction with a light-sensitive silver halide by heating in a substantially water-free condition.

More particularly, this invention relates to a novel process for obtaining a color image by transferring the dye released by heating into a dye fixing layer.

BACKGROUND OF THE INVENTION

A photographic process utilizing a silver halide has heretofore been widely used due to its excellent photographic characteristics such as sensitivity, control of gradation, etc., as compared with other photographic processes such as an electrophotographic process or a diazo photographic process. In recent years, with respect to image formation processes for light-sensitive materials using a silver halide, a technique capable of easily and quickly obtaining an image, for example, a dry development process such as a process using heat, has been developed for the conventional wet development process using a developing solution.

Heat-developable light-sensitive materials are known in the art. Heat-developable light-sensitive materials and processes suitable therefor are described in, for example, *Shashin Kogaku no Kiso,* Corona Co., Ltd. pages 553–555, *Eizo Joho,* April 1978, page 40, *Nebletts, Handbook of Photography and Reprography,* 7th ed., Van Nostrand Reinhold Company, pages 32–33, U.S. Pat. Nos. 3,152,904, 3,301,678, 3,392,020 and 3,457,075, British Pat. Nos. 1,131,108 and 1,167,777, and *Research Disclosure,* June 1978, pages 9–15 (RD-17029).

Various processes for obtaining color images using a dry process have been proposed.

With respect to processes for forming color images by the reaction of an oxidation product of a developing agent with a coupler, use of a p-phenylenediamine type reducing agent and a phenolic coupler or an active methylene coupler as disclosed in U.S. Pat. No. 3,531,286, p-aminophenol type reducing agent as disclosed in U.S. Pat. No. 3,761,270, a sulfonamidophenol type reducing agent as disclosed in Belgian Pat. No. 802,519 *and Research Discosure,* pages 31–32 (September, 1975) and the combination of a sulfonamidophenol type reducing agent and a 4-equivalent coupler as disclosed in U.S. Pat. No. 4,021,240 has been proposed.

These processes, however, are disadvantageous in that turbid color images are formed, because a reduced silver image and a color image are simultaneously formed in the exposed area after heat-development. In order to eliminate these disadvantages, a process which comprises removing a silver image by liquid processing and a process which comprises transferring only the dye to another layer, for example, a sheet having an image receiving layer have been proposed. However, the latter process is not desirable because it is not eady to transfer only the dye as opposed to unreacted substances.

Another process which comprises introducing a nitrogen containing heterocyclic group into a dye, forming a silver salt and releasing a dye by heat-development has been proposed in *Research Disclosure,* RD-16966, pages 54–58 (May, 1978). With this process, clear images can not be obtained because it is difficult to control the release of dyes from the non-exposed areas, and thus it is not a generally applicable process.

Further, processes for forming a positive-working color image by a silver dye bleach process utilizing heat as well as useful dyes therefor and methods for bleaching are disclosed in, for example, *Research Disclosure,* RD-14433, pages 30–32 (April, 1976), ibid., RD-15227, pages 14–15 (December, 1976) and U.S. Pat. No. 4,235,957.

However, these processes require an additional step and an additional meterial for accelerating a bleaching of the dyes, for example, a step of heating with a superposed sheet with an activating agent. Furthermore, they have the disadvantage that the resulting color images are gradually reduced and bleached by free silver which is also present during storage for a long period of time.

Moreover, a process for forming a color image utilizing a leuco dye has been disclosed in, for example, U.S. Pat. Nos. 3,985,565 and 4,022,617. This process is, however, disadvantageous in that it is difficult to incorporate the leuco dye in the photographic material in a stable manner and coloration gradually occurs during storage.

In addition, all of the above-described conventional processes generally require long periods of time for development and the resulting images have high fog and low density.

In order to overcome the above-described disadvantages, many improved processes for color image formation have been porposed, in which a mobile dye is imagewise released by the oxidation-reduction reaction between a light-sensitive silver halide and a dye releasing redox compound and the released mobile dye is transferred to a dye fixing layer, as disclosed in EP Patent Publications Nos. 76,492 and 79,056 and Japanese patent application (OPI) Nos. 149046/83 and 149047/83.

In one such image formation process, a dye fixing material having a dye fixing layer is brought into contact with a light-sensitive material, thereby the imagewise formed mobile dye is transferred into the dye fixing layer. According to this process, the dye fixing layer should be peeled apart from the light-sensitive material after the dye is transferred. Therefore, the dye fixing material must have surface properties such that it adheres to the light-sensitive material intimately enough to allow thorough transferring of the mobile dye; movement of the dye is not interfered with; it can be peeled off smoothly after heating; and the surface of the dye fixing layer is not roughened upon peeling off.

With respect to the peeling property or separability of dye fixing materials, various proposals for color diffusion transferring materials have been made, and those using a hydrophilic polymer on the surface are known. However, since the above-described image formation process involves heating at 60° C. or higher temperatures for dye transferring, if gelatin, polyvinylpyrrolidone, etc., commonly employed are used on the surface, it becomes quite difficult to peel the dye fixing material from the light-sensitive material and forced separation would result in a damage of the surface of the dye fixing material.

SUMMARY OF THE INVENTION

Accordingly, an object of the present invention is to provide a process for forming a color image by heating, by which separability between a portion containing a light-sensitive layer such as a light-sensitive material and a portion containing a dye fixing layer such as a dye fixing material which contact each other and have been heated is improved and the surface of the portion containing the dye fixing layer is prevented from being damaged.

Another object of the present invention is to provide an easy process for obtaining a color image having a high quality and an excellent surface property by heating.

The above objects are accomplished by a process for forming a color image comprising exposing and heating a light-sensitive material comprising a support having thereon a light-sensitive silver halide, a binder and a compound capable of forming or releasing a mobile dye chemically in connection with reduction of the silver halide into silver upon heating, transferring and fixing the thus formed or released mobile dye to a dye fixing layer, and then separating the portion having the silver halide and the compound capable of forming or releasing a mobile dye and the portion having the dye fixing layer from each other, and the process further involves incorporating polyvinyl alcohol into at least one of the layers having a separable surface, i.e., at least one surface layer of the light-sensitive material and the dye fixing layer being separated.

DETAILED DESCRIPTION OF THE INVENTION

In the present invention, transfer of a mobile dye is preferably carried out by heating. The heating may be effected either by heating for developmet or by heating separately.

The term "to form or release a mobile dye chemically in connection with reduction of a silver halide into silver upon heating" as used herein means the following four reactions: for example, in using a negative-working silver halide emulsion, a developing nucleus is formed in the silver halide upon exposure, and an oxidation-reduction reaction takes place between the silver halide containing the developing nucleus and a reducing agent or a reductive layer releasing redox compound, thus resulting in (1) a reaction between an oxidation product of the reducing agent and a compound capable of forming or releasing a mobile dye, thereby to form or release a mobile dye; (2) an oxidation-reduction reaction between the excess of the reducing agent which remains unoxidized and a dye releasing redox compound capable of releasing a mobile dye, thereby to form a reduction product of a dye releasing redox compound which is incapable of releasing a mobile dye; (3) a reaction in which the reducing dye releasing redox compound is oxidized thereby a moble dye; and (4) a reaction in which the reducing dye releasing redox compound capable of releasing a mobile dye is oxidized by heating, thereby producing the corresponding oxidation product which is not capable of releasing a mobile dye. In using a positive-working silver halide emulsion, the above-described reactions take place in the non-exposed areas. In reactions (1) and (3), a dye image positive to a silver image is obtained, and in reactions (2) and (4) a dye image negative to a silver image is obtained.

The compounds which are capable of forming or releasing a mobile dye used in the present invention include the following compounds:

(I) A dye releasing redox compound capable of releasing a mobile dye upon reaction with the oxidation product of a reducing agent which is formed by the oxidation-reduction reaction between a silver halide and a reducing agent by heating [i.e., a compound capble of releasing a mobile dye through the above-described reaction (1)].

Specific examples of these dye releasing redox compounds are disclosed in EP Patent Publication No. 79056. These compounds can be represented by the formula C-L-D wherein D represents a dye moiety for image formation as hereinafter described; L represents a bonding group that induces cleavage of the C-L linkage upon reaction between the oxidation product of a reducing agent and the moiety C; and C represents a substrate that is to bond with the oxidation product of a reducing agent, for example, active methylene, active methine, a phenol residue or a naphthol residue. Compounds of the formula C-L-D preferably are represented by the following formulae (A) to (G):

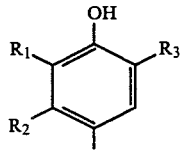

(A)

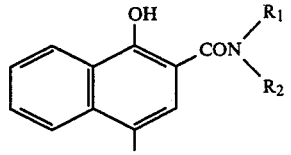

(B)

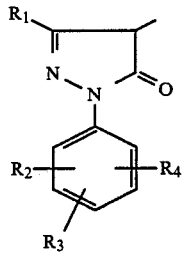

(C)

$R_1COCHCOR_2$
|
(D)

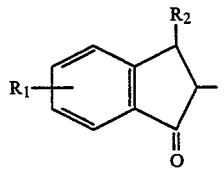

(E)

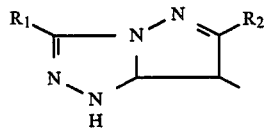

(F)

-continued

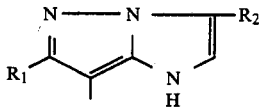

(G)

wherein $R_1$, $R_2$, $R_3$ and $R_4$ each represents a hydrogen atom, an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group and a cyano group, each of which groups may be additionally substituted with a hydroxy group, a cyano group, a nitro group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group or an acyl group.

The moiety C is a substrate capable of bonding to the oxidation product of a reducing agent to release a mobile dye and, at the sme time, should bear a ballast group to prevent the dye releasing redox compound itself from diffusing into a dye-accepting image receiving layer. Suitable ballast groups include a hydrophobic group, e.g., an alkyl group, an alkoxyalkyl group, an aryloxyalkyl group, etc. These ballast groups preferably contain at least 6 total carbon atoms and that the substrate C contains at least 12 total carbon atoms.

(II) A coupler capable of forming a mobile dye upon coupling reaction with the oxidation product of a reducing agent which is formed by the oxidation-reduction reaction between the reducing agent and a silver halide by heating [i.e., a compound capable of forming a mobile dye through the above-described reaction (2)].

Such a coupler includes a coupler having a removable group having an anti-diffusive group sufficient to render the coupler anti-diffusive as disclosed in Japanese patent application (OPI) Nos. 149046/83 and 149047/83.

(III) A compound capable of releasing a mobile dye upon heating but incapable of releasing a mobile dye upon oxidation-reduction reaction with a silver halide by heating [i.e., a compound operating in the above-described reactions (2) to (4)].

Examples of compound operable in reaction (2) are described in U.S. Pat. No. 4,139,379 as compounds capable of inducing an intramolecular nucleophilic reaction.

Examples of compound operable in reaction (4) are those compounds where their nucleophilic groups are reduced, as disclosed in U.S. Pat. No. 4,139,379.

(IV) A dye releasing redox compound which is reductive to a silver halide and capable of releasing a mobile dye upon oxidation-reduction reaction with the silver halide which occurs by heating [i.e., a compound used in the above-described reaction (3)].

These dye releasing redox compounds are disclosed in EP Patent Publication No. 76,493 and are represented by the following general formula (I):

$$Ra—SO_2—D \quad (I)$$

wherein ra represents a reducing group capable of being oxidized by the silver halide; and D represents an image forming dye portion containing a hydrophilic group.

Preferably the reducing group Ra in the dye releasing redox compound $Ra—S_2—D$ has an oxidation-reduction potential to a saturated calomel electrode of 1.2 V or less measuring the polarographic half wave potential using acetonitrile as a solvent and sodium perchlorate as a base electrolyte. Preferred examples of the reducing group Ra include those represented by the following general formulae (II) to (IX).

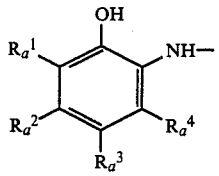

(II)

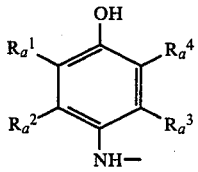

(III)

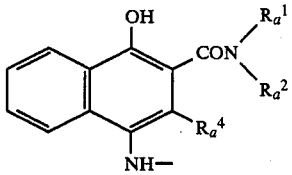

(IV)

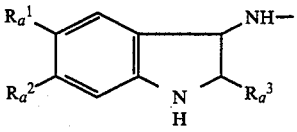

(V)

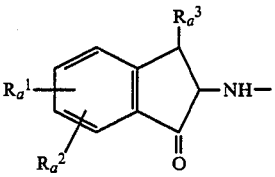

(VI)

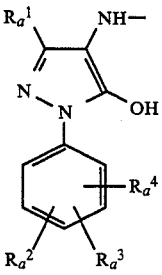

(VII)

-continued (VIII)

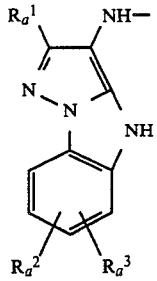

(IX)

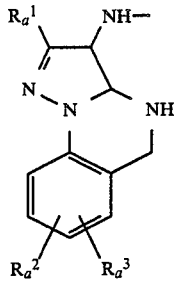

wherein $R_a^1$, $R_a^2$, $R_a^3$ and $R_a^4$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkyl-sulfonylamino group, an arylsulfonylamino group, a substituted ureido group or a carboalkoxy group. Furthermore, the hydroxy group and the amino included in the reducing group represented by Ra may be protected by a protective group capable of reproducing the hydroxy group and the amino group by the action of a nucleophilic agent.

In more preferred embodiments of the present invention, the reducing group Ra is represented by the following general formula (X).

(X)

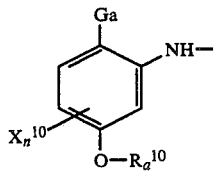

wherein Ga represents a hydroxy group or a group giving a hydroxy group upon hydrolysis; $R_a$ represents an alkyl group or an aromatic group; n represents an integer of 1 to 3; $X^{10}$ represents an electron donating substituent when n is 1 or substituents, which may be the same or different, one of the substituents being an electron donating group and the second or second and third substituents being selecged from an electron donating group or a halogen atom when n is 2 or 3, respectively; wherein $X^{10}$ groups may form a condensed ring with each other or with $OR_a^{10}$; and the total number of the carbon atoms included in $R_a^{10}$ and $X^{10}$ is not less than 8.

Of the reducing groups represented by the general formula (X), more preferred reducing groups Ra are represented by the following general formulae (Xa) and (Xb):

(Xa)

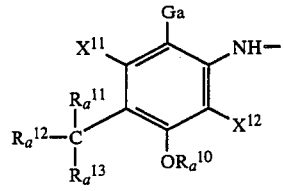

wherein Ga represents a hydroxy group or a group giving a hydroxy group upon hydrolysis; $R_a^{11}$ and $R_a^{12}$, which may be the same or different, each represents an alkyl group or $R_a^{11}$ and $R_a^{12}$ may be bonded to each other to form a ring; $R_a^{13}$ represents a hydrogen atom or an alkyl group; $R_a^{10}$ represents an alkyl group or an aromatic group; $X^{11}$ and $X^{12}$, which may be the same or different, each represents a hydrogen atom, an alkyl group, an alkoxy group, a halogen atom, an acylamino group or an alkylthio group; and $R_a^{10}$ and $X^{12}$ or $R_a^{10}$ and $R_a^{13}$ may be bonded to each other to form a ring, (Xb)

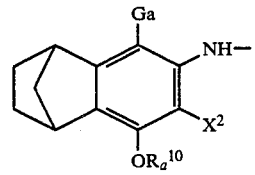

wherein Ga represents a hydroxy group or a group giving a hydroxy group upon hydrolysis; $R_a^{10}$ represents an alkyl group or an aromatic group; $X^2$ represents a hydrogen atom, an alkyl group, an alkoxy group, a halogen atom, an acylamino group or an alkylthio group; and $X^2$ and $R_a^{10}$ may be bonded to each other to form a ring.

Specific examples of the reducing groups represented by the above described general formulae (X), (Xa) and (Xb) are described in U.S. Pat. No. 4,055,428, Japanese patent application (OPI) Nos. 12642/81 and 16130/81, respectively.

In other more preferred embodiments of the present invention, the reducing group Ra is represented by the following general formula (XI).

(XI)

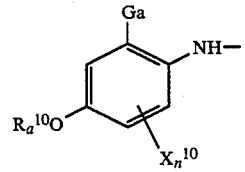

wherein Ga, $X^{10}$, $R_a^{10}$ and n each has the same meaning as Ga, $X^{10}$, $R_a^{10}$ and n defined in the general formula (X).

Of the reducing groups represented by the general formula (XI), more preferred reducing groups Ra are represented by the following general formulae (XIa), (XIb) and (XIc)

(XIa)

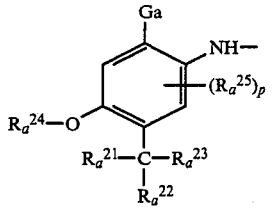

wherein Ga represents a hydroxy group or a group giving a hydroxy group upon hydrolysis; $R_a^{21}$ and $R_a^{22}$, which may be the same or different, each represents an alkyl group or an aromatic group, and $R_a^{21}$ and $R_a^{22}$ may be bonded to each other to form a ring; $R_a^{23}$ represents a hydrogen atom, an alkyl group or an aromatic group; $R_a^{24}$ represents an alkyl group or an aromatic group; $R_a^{25}$ represents an alkyl group, an alkoxy group, an alkylthio group, an arylthio group, a halogen atom or an acylamino group; p is 0, 1 or 2; $R_a^{24}$ and $R_a^{25}$ may be bonded to each other to form a condensed ring; $R_a^{21}$ and $R_a^{24}$ may be bonded to each other to form a condensed ring; $R_a^{21}$ and $R_a^{25}$ may be bonded to each other to form a condensed ring; and the total number of the carbon atoms included in $R_a^{21}$, $R_a^{22}$, $R_a^{23}$, $R_a^{24}$ and $(R_a^{25})_p$ is more than 7.

(XIb)

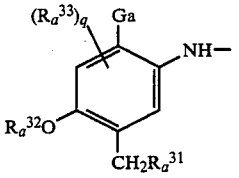

wherein Ga represents a hydroxy group or a group giving a hydroxy group upon hydrolysis; $R_a^{31}$ represents an alkyl group or an aromatic group; $R_a^{32}$ represents an alkyl group or an aromatic group; $R_a^{33}$ represents an alkyl group, an alkoxy group, an alkylthio group, an arylthio group, a halogen atom or an acylamino group; q is 0, 1 or 2; $R_a^{32}$ and $R_a^{33}$ may be bonded to each other to form a condensed ring; $R_a^{31}$ and $R_a^{32}$ may be bonded to each other to form a condensed ring; $R_a^{31}$ and $R_a^{33}$ may be bonded to each other to form a condensed ring; and the total number of the carbon atoms included in $R_a^{31}$, $R_a^{32}$ and $(R_a^{33})_q$ is more than 7.

(XIc)

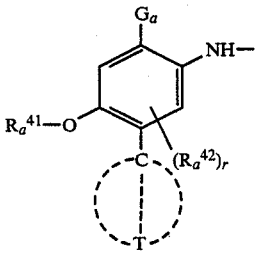

wherein Ga represents a hydroxy group or a group giving a hydroxy group upon hydrolysis; $R_a^{41}$ represents an alkyl group or an aromatic group; $R_a^{42}$ represents an alkyl group, an alkoxy group, an alkylthio group, an arylthio group, a halogen atom or an acylamino group; r is 0, 1 or 2; the group of

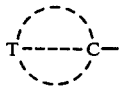

represents a group in which 2 to 4 saturated hydrocarbon rings are condensed, the carbon atom

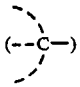

in the condensed ring which is connected to the phenol nucleus (or a precursor thereof), represents a tertiary carbon atom which composes one of the pivot of the condensed ring, a part of the carbon atoms (excluding the above described tertiary carbon atom) in the hydrocarbon ring may be substituted for oxygen atom(s), the hydrocarbon ring may have a substituent, and an aromatic ring may be further condensed to the hydrocarbon ring; $R_a^{41}$ or $R_a^{42}$ and the group of

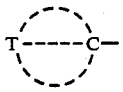

may be bonded to each other to form a condensed ring; and the total number of the carbon atoms included in $R_a^{41}$, $(R_a^{42})_r$ and the group of

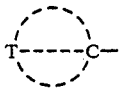

is not less than 7.

Specific examples of the reducing groups represented by the above described general formulae (XI), (XIa), (XIb) and (XIc) are described in Japanese Patent Application (OPI) Nos. 16131/81, 650/82 and 4043/82.

The essential part in the groups represented by the general formula (III) and (IV) is a para(sulfonyl)aminophenol part. Specific examples of these reducing groups are described in U.S. Pat. Nos. 3,928,312 and 4,076,529, U.S. Published patent application B Ser. No. 351,673, U.S. Pat. Nos. 4,135,929 and 4,258,120. These groups are also effective for the reducing group Ra according to the present invention.

In still other more preferred embodiments of the present invention, the reducing group Ra is represented by the following general formula (XII).

(XII)

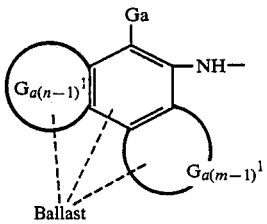

wherein Ballast represents a diffusion-resistant group; Ga represents a hydroxy group or a precursor of a hydroxy group; $Ga_a^1$ represents an aromatic ring directly condensed to the benzene nucleus to form a naphthalene nucleus; and n and m are dissimilar positive integers of 1 to 2.

Specific examples of the reducing groups represented by the above described general formula (XII) are described in U.S. Pat. No. 4,053,312.

The reducing groups represented by the above described general formula (V), (VII), (VIII) and (IX) are characterized by containing a heterocyclic ring. Specific examples of the groups are described in U.S. Pat. No. 4,198,235, Japanese Patent Application (OPI) No. 46730/78 and U.S. Pat. No. 4,273,855.

Specific examples of the reducing groups represented by the general formula (VI) are described in U.S. Pat. No. 4,149,892.

Characteristics required for the reducing group Ra are as follows.

1. It is rapidly oxidized by the silver halide to effectively release a diffusible dye for image formation by the function of the dye releasing activator.

2. The reducing group Ra has an extensive hydrophobic property, because it is necessary for the dye releasing redox compound to be diffusion-resistant in a hydrophilic or hydrophobic binder and that only the released dye has diffusibility.

3. It has excellent stability to heat and to the dye releasing activator and does not release the image forming dye until it is oxidized; and 4. It is easily synthesized.

In the following, specific examples of preferred reducing groups Ra which satisfy the above described requirements are shown. In the examples, NH— represents the bond to the dye portion.

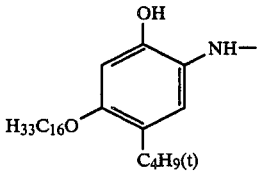

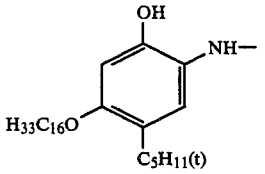

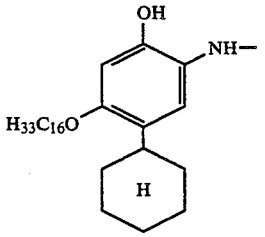

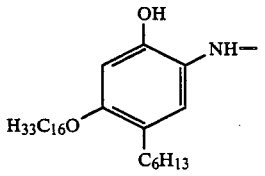

-continued

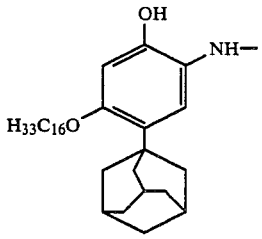

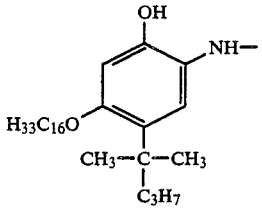

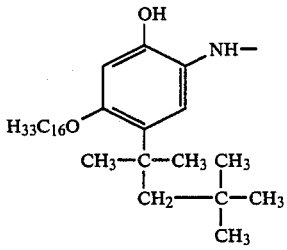

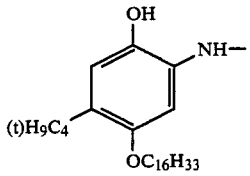

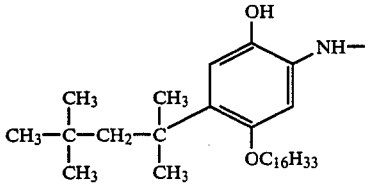

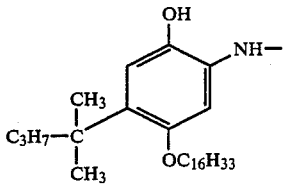

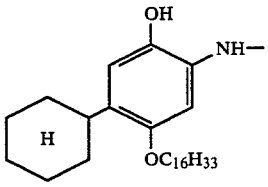

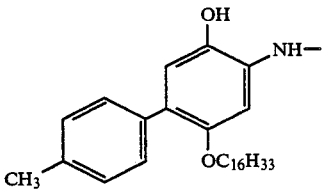

-continued

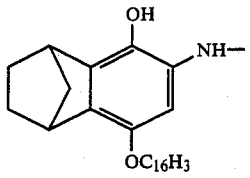

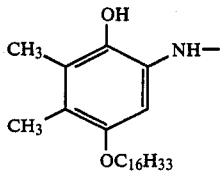

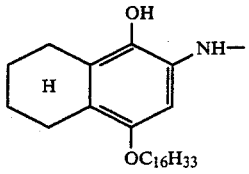

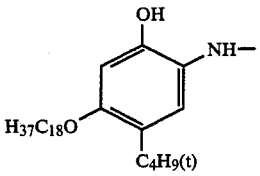

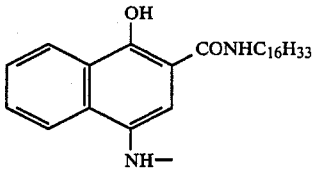

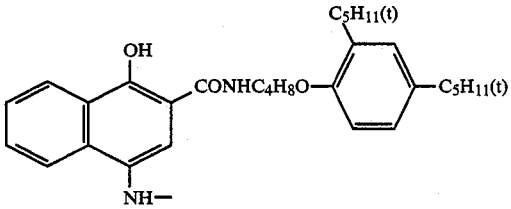

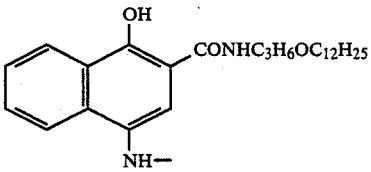

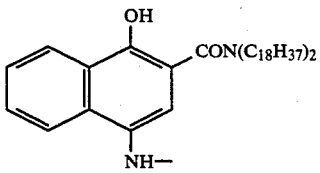

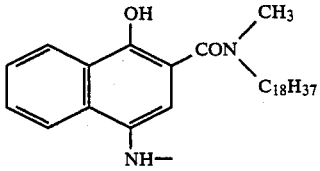

-continued

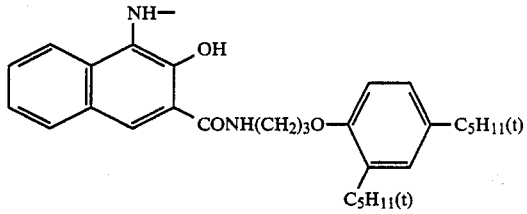

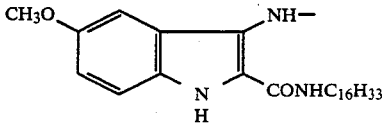

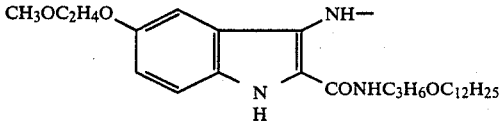

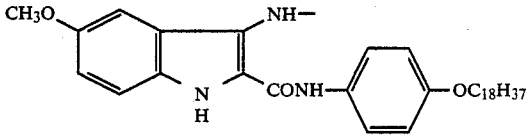

Examples of dyes which can be used for image forming dye include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a form temporarily shifted to shorter wavelength region which is capable of regeneration during the development processing.

Yellow:

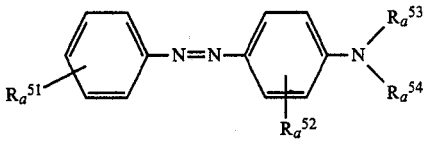

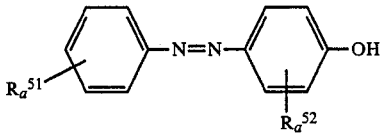

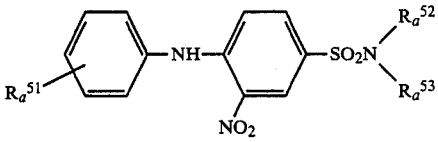

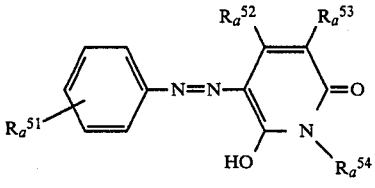

-continued
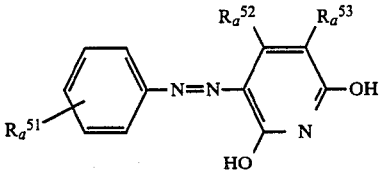
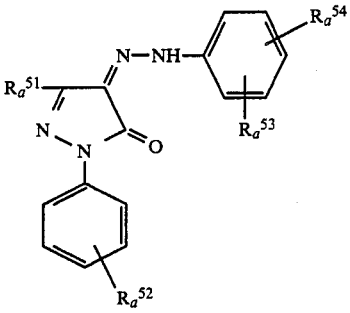
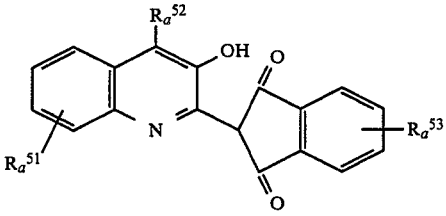
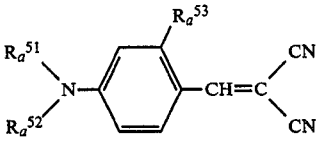
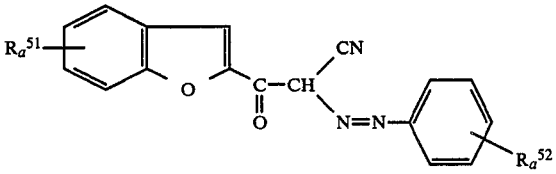
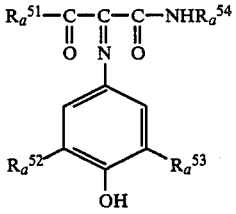
Magenta:
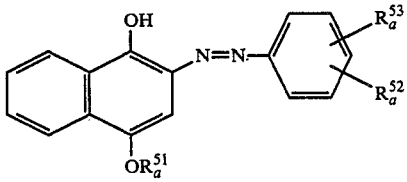
-continued
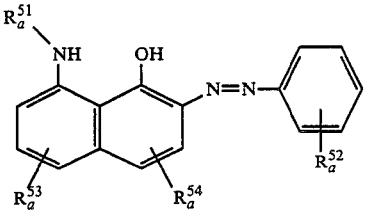
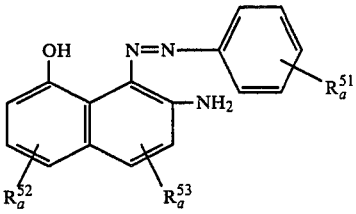
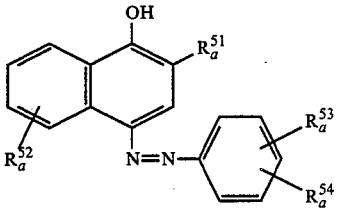
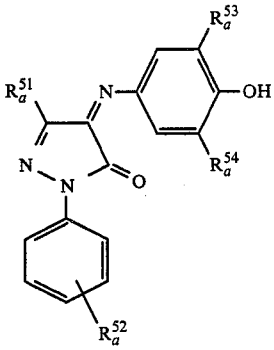
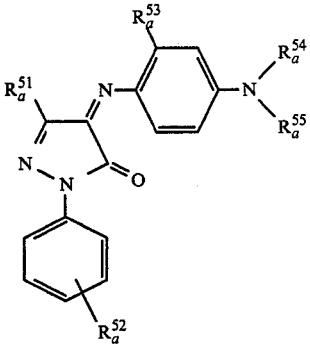
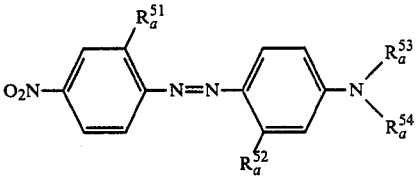

-continued
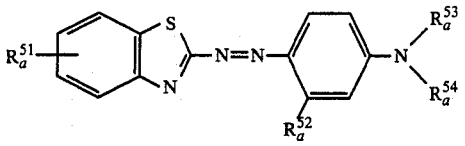
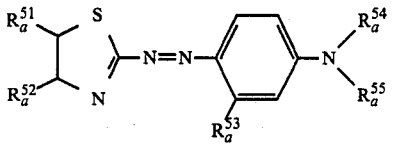
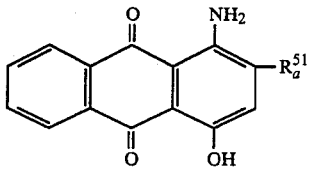
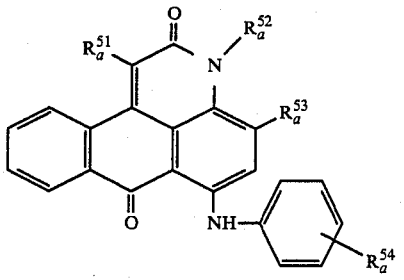
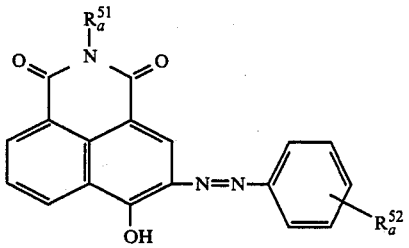
Cyan:
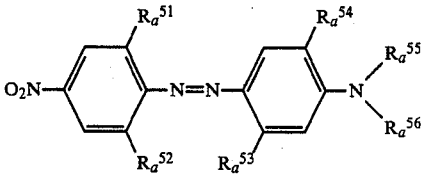
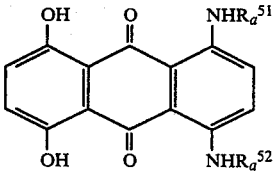
-continued
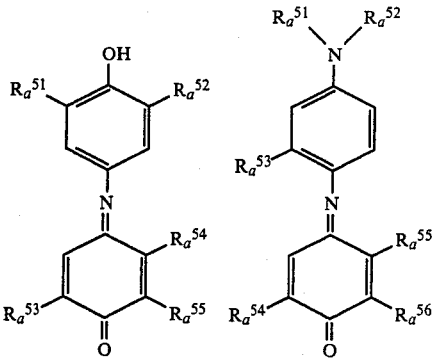
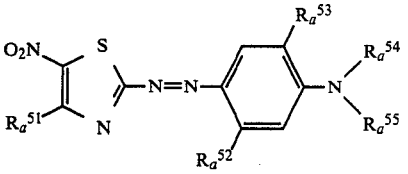
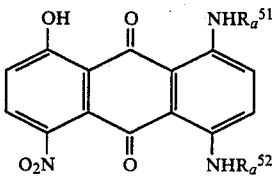
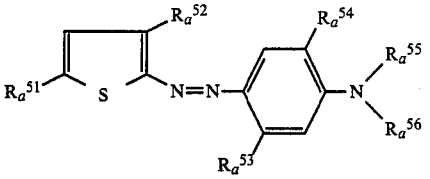
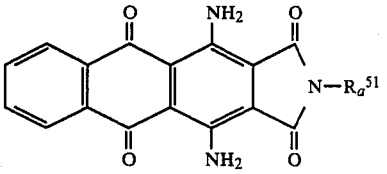
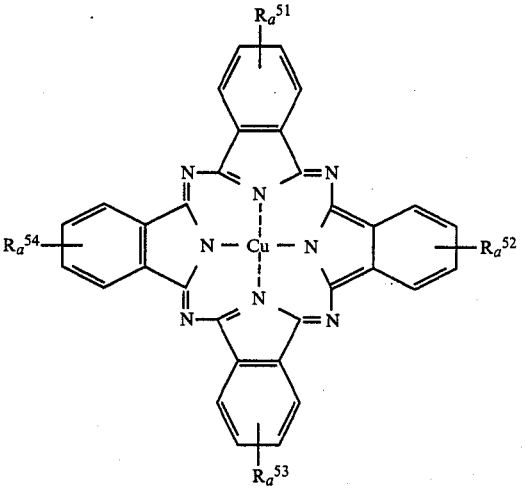

-continued

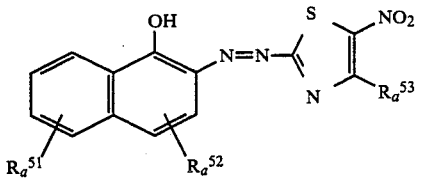

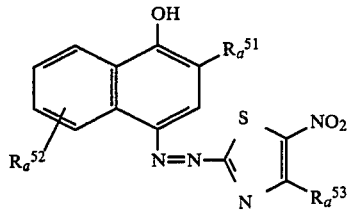

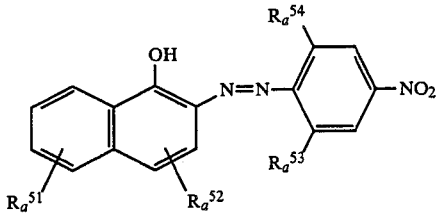

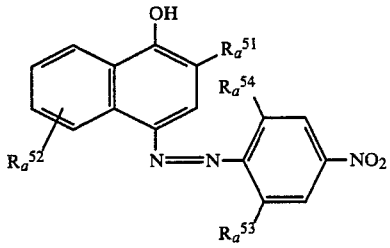

In the above described formulae, $R_a^{51}$ to $R_a^{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group or an arylthio group. The alkyl moiety and the aryl moiety in the above described substituents may be further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group.

Examples of the hydrophilic groups include a hydroxy group, a carboxyl group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition are particularly preferred. Examples of these groups include a phenolic hydroxy group, a carboxy group, a sulfo group, a phosphoric acid group, an imido group, a hydroxamic acid group, a (substituted) sulfamoyl group, a (substituted) sulfamoylamino group, etc.

Characteristics required for the image forming dye are as follows.

1. It has a hue suitable for color reproduction.
2. It has a large molecular extinction coefficient.
3. It is fast to light and heat and stable for the dye releasing activator and other additives included in the system; and
4. It is easily synthesized.

Specific examples of preferred image forming dyes which satisfy the above described requirements are described in the following. In the examples, $H_2NSO_2$— represents a group necessary to bond to the reducing group.

Yellow

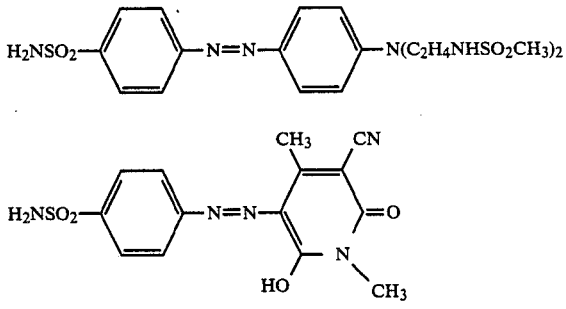

-continued
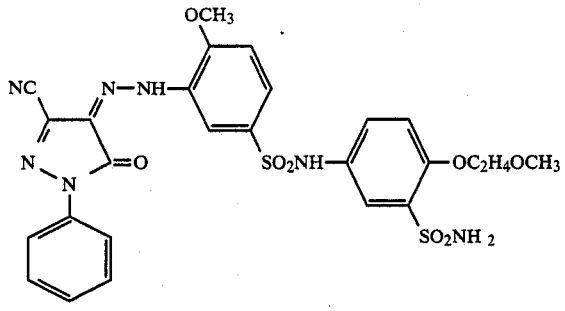
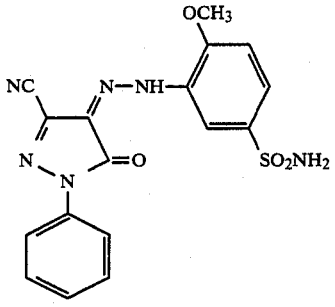
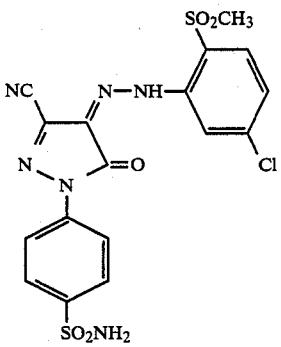
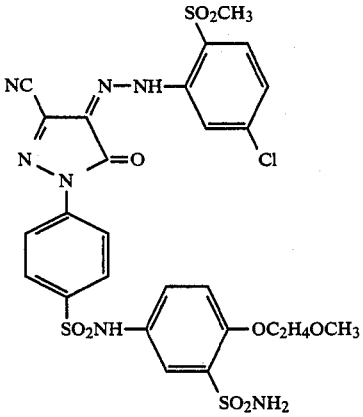
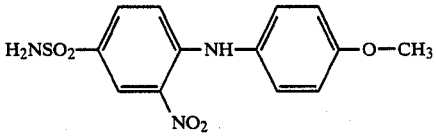

-continued
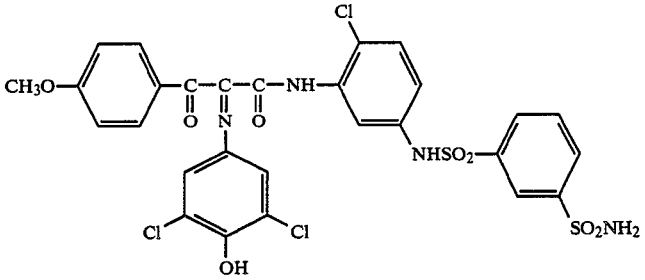
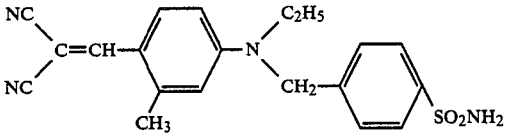
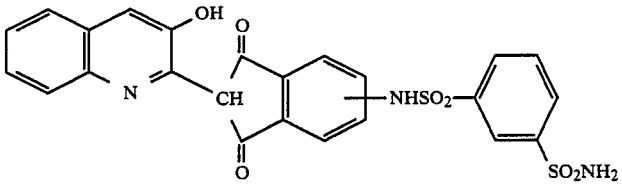
Magenta
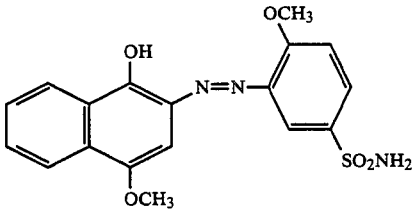
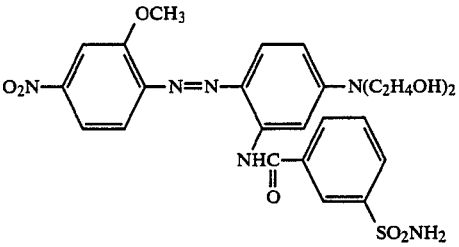
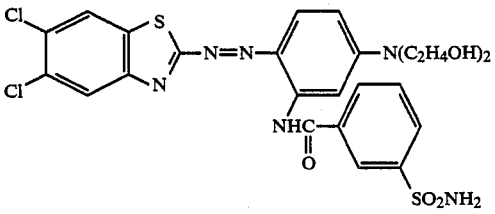
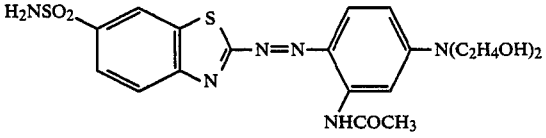
-continued
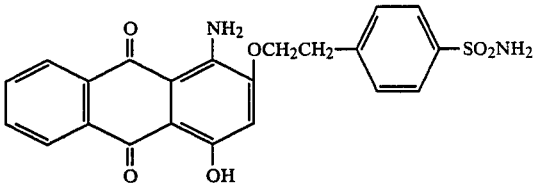
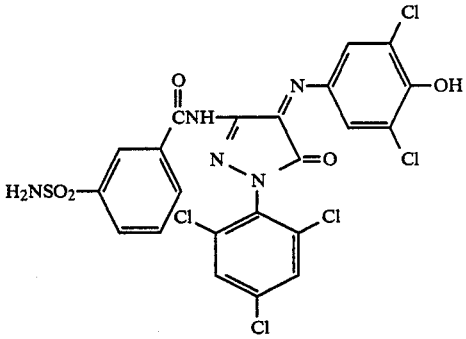
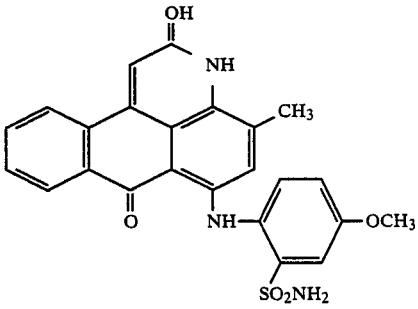

-continued

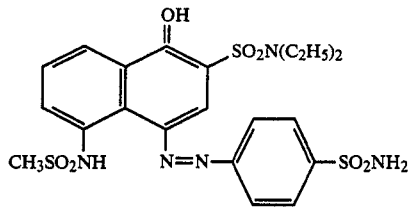

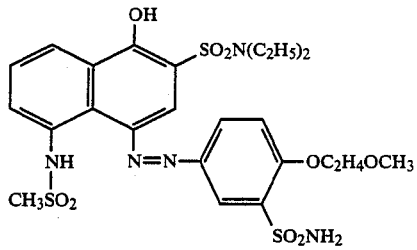

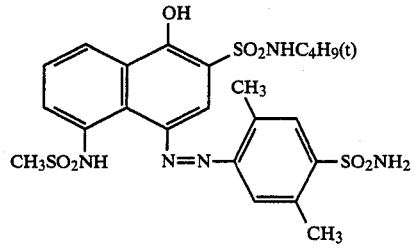

Cyan

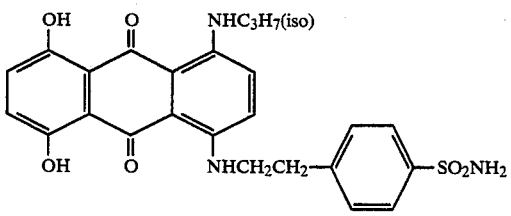

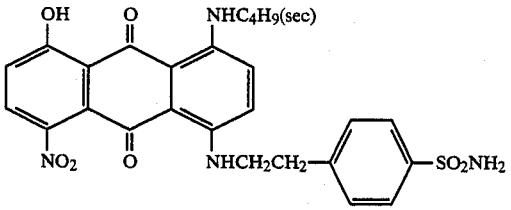

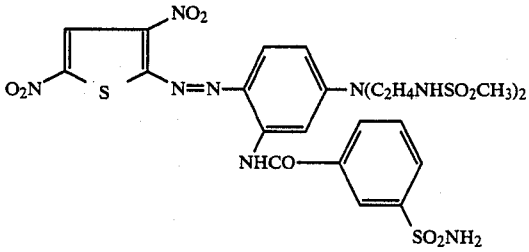

-continued

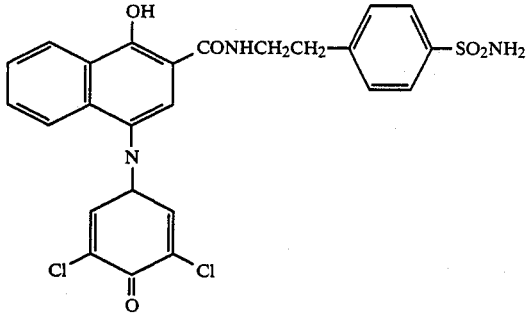

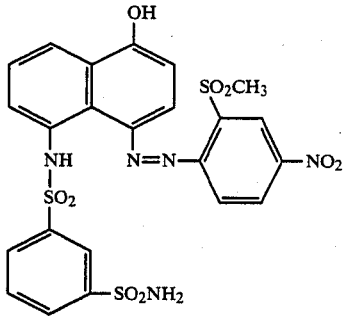

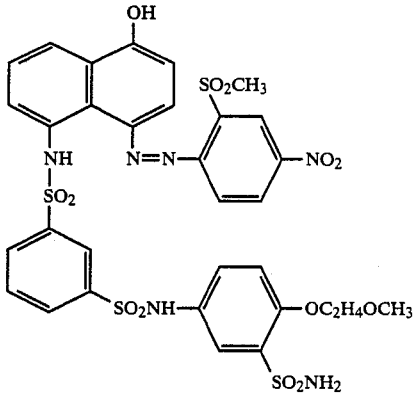

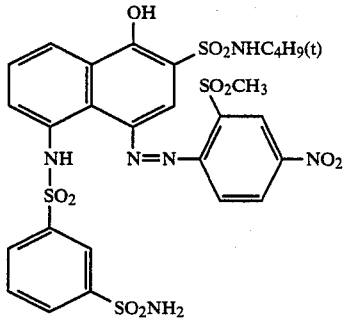

In a preferred embodiment of the present invention, a light-sensitive material containing a silver halide and a compound capable of forming or releasing a mobile dye is heat-developed and brought into contact with a dye fixing material having a dye fixing layer. After heating to transfer the dye, the dye fixing material is peeled apart therefrom. In another preferred embodiment of the present invention, a light-sensitive layer and a dye fixing layer are previously superposed on the same support, and the light-sensitive layer is peeled apart therefrom after dye transferring.

It is sufficient that the polyvinyl alcohol be present in at least one of the layer having a separable surface at the time of heating for dye transfer. Further, even if a layer having a separable surface and containing no polyvinyl alcohol is formed on a polyvinyl alcohol-containing layer, such is within the scope of the present invention as long as the polyvinyl alcohol-containing layer is substantially in contact with the separable surface of the facing layer to be peeled off at the time of heating for the dye transfer.

If desired, the polyvinyl alcohol-containing layer may further contain a silver halide, a compound capable of forming or releasing a mobile dye or other additives useful for photographic light-sensitive materials.

The objects of the present invention can be attained by forming a layer containing polyvinyl alcohol in an amount not less than about 50% by weight, preferably not less than 75% by weight, based on the weight of the coating of the layer and having a thickness not less than about 0.1μ, preferably not less than 0.5μ, on a separable surface of the layer.

Furthermore, the polyvinyl alcohol may be incorporated into other layers formed for other purposes and may be used in combination with other binders.

It is not necessary for the polyvinyl alcohol-containing layer to have the above-specified polyvinyl alcohol content throughout the thickness, i.e., it is sufficient for the polyvinyl alcohol content to be in the portion of the layer of at least 0.1μ in thickness from the separable surface. There is, of course, no problem if the layer contains this amount of polyvinyl alcohol in a thickness over 0.1μ.

The effect produced by the present invention is particularly conspicuous when the separation of layers is carried out at high temperatures of about 60° C. or more.

The effect of the present invention is achieved irrespective of which of the two separable layers (one of a portion having a dye fixing layer and another of a portion having a light-sensitive layer) contains the polyvinyl alcohol, but, in view of production efficiency, quality of an image, etc., it is preferred for the polyvinyl alcohol to be in the portion having a dye fixing layer.

The polyvinyl alcohol which can be used in the present invention can have various degrees of saponification and degrees of polymerization, but preferably the polyvinyl alcohol has a degree of saponification of about 70% or more, more particularly 80% or more, and a degree of polymerization of about 300 to 2,000. A combination of polyvinyl alcohols having different degrees of saponification or polymerization can be used, if desired. Further, any polyvinyl alcohol obtained by either acid saponification or alkali saponification can be used in the present invention.

Specific examples of the polyvinyl alcohol that meet the above-described conditions include, for example, PVA-105, PVA-124, PVA-CS and PVA-HC as completely saponified polyvinyl alcohols and PVA-203, PVA-240 and L-8 as partially saponified polyvinyl alcohols, all of which are trade names for products produced by Kuraray Co., Ltd.

The dye releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

An amount of the organic solvent having a high boiling point used in the present invention is 10 g per g of the dye releasing redox compound used or less and preferably 5 g per g or less.

In the present invention, if necessary, the so-called auxiliary developing agent can be used even when the dye releasing redox compound is used. The auxiliary developing agent in this case is a compound which is oxidized upon the silver halide to form its oxidized product having an ability to oxidize the reducing group Ra in the dye releasing redox compound.

Examples of useful auxiliary developing agents include hydroquinone, alkyl substituted hydroquinones such as tertiary butylhydroquinone, 2,5-dimethylhydroquinone, etc., catechols, pyrogallols, halogen substituted hydroquinones such as chlorohydroquinone, dichlorohydroquinone, etc., alkoxy substituted hydroquinones such as methoxyhydroquinone, and polyhydroxybenzene derivatives such as methyl hydroxynaphthalene, etc. Further, methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone, 4-methyl-4-hydroxymethyl-1-phenyl-3-pyrazolidone, etc., reductones and hydroxy tetronic acids are useful.

The auxiliary developing agent can be used in an amount of a fixed range. A suitable range is 0.0005 time by mol to 20 times by mol based on silver. A particularly suitable range is 0.001 time by mol to 4 times by mol.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its particle. That is, the silver halide the X-ray diffraction pattern of which shows that of pure silver iodide is particularly preferred.

In photographic materials a silver halide containing two or more kinds of halogen atoms can be used. Such a silver halide yields a completely mixed crystal in a conventional silver halide emulsion. For example, the particle of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its particle and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above described image-forming substance or a reducing agent coexisting, if necessary, with the image-forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessary to have the characteristic in that the silver halide contains pure silver iodide crystal in the case of using the silver halide along. Any silver halide which is known in the art can be used.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxy group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, slver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione, etc., as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)-benzothiazole, a silver salt of thioglycolic acid such as a silver salt of an S-allyl thioglycol acetic acid (wherein the alkyl group has from 12 to 22 carbon atoms) as described in Japanese patent application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Two or more organic silver salt oxidizing agents can be used together.

The mechanism of the heat-development process under heating in the present invention is not entirely clear, but it is believed to be as follows.

When the light-sensitive material is exposed to light, a latent image is formed in a light-sensitive silver halide. This phenomenon is described in T. H. James, *The The-*

*ory of the Photographic Process,* Third Edition, pages 105 to 148.

When the light-sensitive material is heated, the reducing agent, the dye releasing redox compound, in the case of the present invention reduces the silver halide or the silver halide and the organic silver salt oxidizing agent in the presence of the latent image nuclei as a catalyst to form silver, while it is oxidized itself. The oxidized product of the dye releasing redox compound is cleaved to release a dye.

Methods of preparing these silver halide and organic silver salt oxidizing agents and manners of blending them are described in *Research Disclosure,* No. 17029, Japanese patent application (OPI) Nos. 32928/75 and 42529/76, U.S. Pat. 3,700,458, and Japanese patent application (OPI) Nos. 13225/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

Useful sensitizing dyes include those described in German Pat. No. 929,080, U.S. Pat. Nos. 2,231,658, 2,493,478, 2,503,776, 2,519,001, 2,912,329, 3,656,959, 3,672,897, 3,694,217, 4,025,349 and 4,046,572, British Pat. No. 1,242,588, Japanese Patent Publication Nos. 14030/69 and 24844/77, etc.

These sensitizing dyes can be employed individually, and can also be employed in combination thereof. A combination of sensitizing dyes is often used, particularly for the purpose of supersensitization.

Representative examples thereof are described in U.S. Pat. Nos. 2,688,545, 2,977,229, 3,397,060, 3,522,052, 3,527,641, 3,617,293, 3,628,964, 3,666,430, 3,672,898, 3,679,428, 3,703,377, 3,769,301, 3,814,609, 3,837,862, and 4,026,707, British Pat. Nos. 1,344,281 and 1,507,803, Japanese Patent Publication Nos. 4936/68 and 12375/78, Japanese patent application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. The polyesters described in U.s. Pat. Nos. 3,634,089 and 3,725,070 are preferably used.

In the present invention, various kinds of dye releasing activator can be used. The dye releasing activator means a substance which accelerates the oxidation-reduction reaction between the light-sensitive silver halide and/or the organic silver salt oxidizing agent and dye releasing redox compound or accelerates release of a dye by means of its nucleophilic action to the oxidized dye releasing redox compound in the dye releasing reaction subsequently occurred, and a base and a base precursor can be used. It is particularly advantageous to use these dye releasing activators in order to accelerate the reactions in the present invention.

Examples of preferred bases are amines which include trialkylamines, hydroxylamines, aliphatic polyamines, N-alkyl substituted aromatic armines, N-hydroxyalkyl substituted aromatic amines and bis[p-(dialkylamino)phenyl]methanes. Further, there are betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444. The base precursor is a substance which releases a basic component by heating. Examples of typical base precursors are described in British Pat. No.

998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.s. Pat. No. 3,220,846 is particularly preferred. Further, aldonic amides as described in Japanese patent application (OPI) No. 22625/75 are preferably used because they decompose at a high temperature to form bases.

These dye releasing activators can be used in an amount of a broad range. A useful range is up to 50% by weight based on the amount of a dry layer coated of the light-sensitive material. A range of 0.01% by weight to 40% by weight is more preferred.

It is advantageous to use a compound represented by the general formula described below in the heat-developable color photographic material in order to accelerate development and accelerate release of a dye.

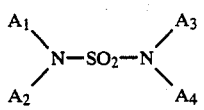

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

Specific examples of the compounds include $H_2NSO_2NH_2$, $H_2NSO_2N(CH_3)_2$, $H_2NSO_2N(C_2H_5)_2$, $H_2NSO_2NHCH_3$, $H_2NSO_2N(C_2H_4OH)_2$, $CH_3NHSO_2NHCH_3$,

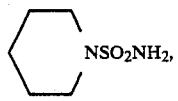

etc.

The above described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese patent application (OPI) No. 88386/75 are useful.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German patent application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylene-bis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having an average molecular weight of 1,500 to 20,000, derivatives of polyethylene oxide such as polyethylene oxide oleic acid ester, etc., beeswax, monostearin, compounds having a high dielectric constant which have an —$SO_2$— or —CO— group such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure,* pages 26 to ;b 28 (Dec., 1976), etc.

In the present invention, though it is not so necessary to further incorporate substances or dyes for preventing irradiation or halation in the light-sensitive material, because the light-sensitive material is colored by the dye releasing redox compound, it is possible to add filter dyes or light absorbing materials, etc., as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an anti-halation layer, a strippable layer, etc.

The photographic emulsion layer and other hydrophilic colloid layers in the light-sensitive material of the present invention may contain various surface active agents for various purposes, for example, as coating aids or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particulrly preferred that the molecule contains 5 or more of the recurring units of ethylene oxide.

The nonionic surface active agents capable of satisfying the above described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Mercel Dekker Inc., 1967), and *Surface Active Ethylene Oxide Adducts,* (edited by Schoufeldt N. Pergamon Press, 1969). Among the nonionic surface active agents described in th above mentioned references, those capable of satisfying the above described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agent, etc.

The protective layer, the intermediate layer, the subbing layer, the back layer and other layers can be produced by preparing each coating solution and applying to a support by various coating methods such as a dip coating method, as air-knife coating method, a curtain coating method or a hopper coating method as described in U.S. Pat. No. 2,681,294 and drying in the same manner as used in preparing the heat-developable light-sensitive layer of the present invention, by which the light-sensitive material is obtained.

If necessary, two or more layers may be applied at the same time by the method as described in U.S. Pat. No. 2,761,791 and British Pat. No. 837,095.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

The original may be line drawings or photographs having gradation. Further, it is possible to take a photograph of a portrait or landscape by means of a camera. Printing from the original may be carried out by contact printing by superposing the original on the material or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and focusing the resulting image on the heat-developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The light-sensitive material to be sensitized by these lights is produced so as to release a yellow dye, a magenta dye and a cyan dye, respectively.

The light-sensitive material is produced using a construction such that the green-sensitive part (layer) contains a yellow dye releasing redox compound, the red-sensitive part (layer) contains a magenta dye releasing redox compound and the infrared-sensitive part (layer) contains a cyan dye releasing redox compound. Other combinations can be utilized, if necessary.

In addition to the above described methods of contacting or projecting the original, there is a method of exposure wherein the original illuminated by a light source is stored in a memory of a reading computer by means of a light-receiving element such as a phototube or a charge coupling device (CCD). The information is, if necessary, subjected to processing, the so-called image treatment, and resulting image information is reproduced on CRT which can be utilized as an image-like light source or lights are emitted by three kinds of LED according to the prcoessed information.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range. Particularly, a temperature range of about 110° C. to about 160° C. is useful.

As the heating means, a simple heat plate, iron, heat roller, heat generator utilizing carbon or titanium white, etc., or analogues thereof may be used.

In the present invention, a specific method for forming a color image by heat development comprises transfer of a hydrophilic mobile dye. For this purpose, the heat-developable color photographic material of the present invention is composed of a support having thereon a light-sensitive layer (I) containing at least silver halide, an organic silver salt oxidizing agent, a dye releasing redox compound which is also a reducing agent for the organic silver salt oxidizing agent and a binder, and a dye fixing layer (II) capable of receiving the hydrophilic diffusible dye formed in the light-sensitive layer (I).

The above described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive material.

Further, there is a method wherein only the light-sensitive layer (I) is exposed imagewise to light and then heated uniformly by superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

Polymer mordants used in the present invention are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cations polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,377,453, etc., aqueous sol type mordants as disclosed in U.S. Pat. Nos. 3,958,995, 2,721,852 and 2,798,063, Japanese patent application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese patent application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese patent application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, for example, mordants capable of cross-linking with a matrix such as gelatin, water-insoluble mordants, and aqueous sol (or latex dispersion) type mordants are preferably used.

Particularly preferably polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

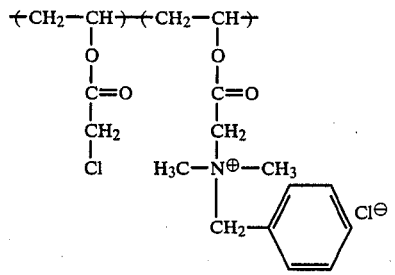

(2) Reaction products between a copolymer comprising a repeating unit of monomer represented by the general formula described below with a repeating unit of another ethylenically unsaturated monomer and a cross-linking agent (for example, bisalkanesulfonate, bisarenesulfonate, etc.):

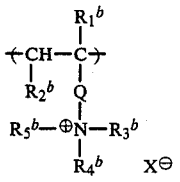

wherein $R_1^b$ represents H or an alkyl group, $R_2^b$ represents H, an alkyl group or an aryl group, Q represents a divalent group, $R_3^b$, $R_4^b$ and $R_5^B$ each represents an alkyl group, an aryl group or at least two of $R_3^b$ to $R_5^b$ are bonded together to form a hetero ring, and X represents an anion. The above described alkyl groups and aryl groups may be substituted.

(3) Polymers represented by the following general formula

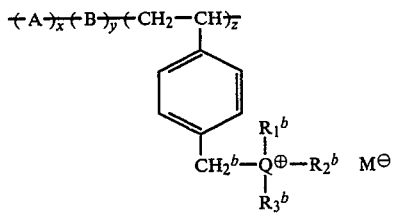

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_1^b$, $R_2^b$, and $R_3^b$ each represents an alkyl group or a cyclic hydrocarbon group or at least two of $R_1^b$ to $R_3^b$ are bonded together to form a ring (these groups and rings may be substituted), and M represents an anion.

(4) Copolymers composed of (a), (b) and (c), wherein (a) is

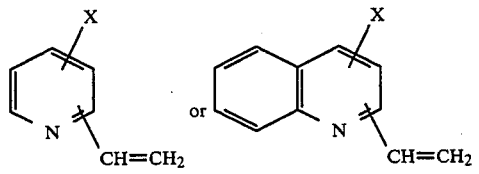

wherein X represents a hydrogen atom, an alkyl group or a halogen atom (the alkyl group may be substituted);

(b) is an acrylic ester; and (c) is acrylonitrile.

(5) Water-insoluble polymers wherein at least ⅓ of the repeating units are those represented by the following general formula

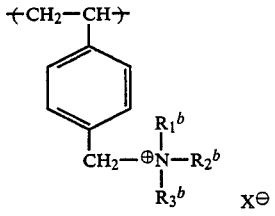

wherein $R_1^b$, $R_2^b$ and $R_3^b$ each represents an alkyl group, with the total number of carbon atoms included being 12 or more (the alkyl group may be substituted), and X represents an anion.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in th art depending on the amount of the dye to be mordanted, the type and composition of the polymer mordant and further on the imageforming process used. Preferably, the ratio of mordant to gelatin is from 20/80 to 80/21 (by weight) and the amount of the mordant coated is from 0.5 to 8 g/m$^2$.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color imges which is observed through the transparent support is obtained.

Typical dye fixing material used in the present invention is obtained by mixing the polymer containing ammonium salt groups with gelatin and applying the mixture to a transparent support.

The transfer of dyes from the light-sensitive layer to the dye fixing layer can be carrier out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethyl-formamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

According to the present invention, a hydrophilic mobile dye which has been imagewise formed by heat-development can be transferred into a dye fixing material and fixed thereto by heating in the presence of a hydrophilic thermal solvent.

In the process for forming an image comprising heating a formed dye in the presence of a hydrophilic thermal solvent thereby transferring the dye to a dye fixing layer, it does not matter whether the transfer of the dye starts simultaneously with the release of the dye or after completion of the release of the dye. Therefore, the heating for the dye transfer may be performed either after the heat-development or simultaneously with the heat-development.

The heating for transferred the dye is carried out at a temperature of from 60° C. to 250° C. from the standpoint of storage stability of the light-sensitive material, workability, etc. Accordingly, in the present invention, the hydrophilic thermal solvent can be appropriately be selected from those exerting the effect as hydrophilic thermal solvents in this temperature range. It is natural that the hydrophilic thermal solvent should assist the dye to rapidly move upon heating. Considering this property as well as heat resistance of the light-sensitive material and the like, the hydrophilic thermal solvent must have a melting point of about 40° to 250° C., preferably 40° to 200° C., more preferably 40° to 150° C.

The above-described hydrophilic thermal solvent is a compound which is solid at normal temperature but becomes liquid upon heating and can be defined to have an (inorganicity/organicity) value of more than 1 and water solubility of not less than 1. The term "organicity" and "inorganicity" are parameters for predicting properties of a compound and are described in detail in *Kagaku no Ryoiki*, 11, 719 (1957), incorporated herein by reference. In the present invention, it is essential for the hydrophilic thermal solvent to have an (inorganicity/organicity) value of 1 or more, preferably 2 or more.

On the other hand, it is believed preferable for molecules which do not interfere with the movement of the mobile dye and are per se movable to be present around the moving dye. Therefore, when considering molecular size, the hydrophilic thermal solvent preferably has a small molecular weight, e.g., less than about 200, more preferably less than about 100.

Since the purpose of using the hydrophilic thermal solvent is to substantially help the hydrophilic dye forming by heat development to be transferred into a dye fixing layer, the hydrophilic thermal solvent may be added to any of a dye fixing layer and a light-sensitive material such as a light-sensitive layer or both of a dye fixing layer and a light-sensitive layer, an independent layer containing the hydrophilic thermal solvent may be formed in a light-sensitive material or an independent dye fixing material having a dye fixing layer may be used from the standpoing of increasing the efficiency of dye transfer into a dye fixing layer, the hydrophilic thermal solvent is preferably added to a dye fixing layer and/or its adjacent layer.

The hydrophilic thermal solvent is usually dissolved in water and then dispersed in a binder, but it can also be used dissolved in an alcohol, such as methanol, ethanol, etc.

Examples of suitable hydrophilic thermal solvents include ureas, pyridines, amides, sulfonamides, imides, alcohols, oximes and other heterocyclic compounds.

These hydrophilic thermal solvents may be used alone or as a combination of two or more thereof.

The amount of the hydrophilic thermal solvent to be added to a light-sensitive material and/or a dye fixing material is about 10 to 300% by weight, preferably 20 to 200% by weight, more preferably 30 to 150% by weight, based on the weight calculated from the total coating thickness of the light-sensitive material and/or a dye fixing material excluding the hydrophilic thermal solvent.

The present invention is illustrated in greater detail by way of the following examples, in which all percentages are by weight unless otherwise indicated.

EXAMPLE 1

A silver iodobromide emulsion was prepared as described below.

40 g of gelatin and 26 g of potassium bromide were dissolved in 3,000 ml of water, and the solution was stirred while maintaining the temperature at 50° C. A solution containing 34 g of silver nitrate dissolved in 200 ml of water was then added to the above prepared solution over a 10 minute period. Subsequently, a solution of 3.3 g of potassium iodide dissolved in 100 ml of water was added thereto over a period of 2 minutes.

By controlling the pH of the silver iodobromide emulsion, precipitates were formed and excess salts were removed. The pH of the emulsion was then adjusted to 6.0 and 400 g of the silver iodobromide emulsion was obtained.

A silver benzotriazole emulsion was prepared by the method described below.

28 g of gelatin and 13.2 g of benzotriazole were dissolved in 3,000 ml of water. The solution was stirred while maintaining the tmperature at 40° C. A solution of 17 g of silver nitrate in 100 ml of water was added thereto over a period of 2 minutes.

By controlling the pH of the silver benzotriazole emulsion, precipitates were formed in excess salts were removed. The pH of the emulsion was then adjusted to 6.0 and 400 g of a silver benzotriazole emulsion was obtained.

A gelatin dispersion of a dye releasing redox compound was prepared as described below.

5 g of Dye Releasing Redox Compound (a) of the formula:

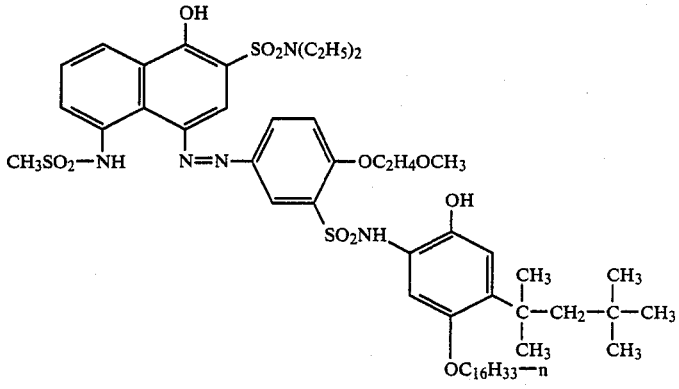

0.5 g of sodium 2-ethylhexylsuccinate sulfonate as a surfactant and 5 g of tricresyl phosphate were added to 20 ml of ethyl acetate and heated at about 60° C. to form a uniform solution. The resulting solution was mixed with 100 g of a 10% aqueous solution of lime-treated gelatin and then dispersed using a homogenizer at 10,000 rpm for 10 minutes.

The resulting dispersion is designated as a dispersion of a magenta dye releasing redox compound.

A light-sensitive coating was prepared as described below.

| | | |
|---|---|---|
| (a) | Silver iodobromide emulsion | 20 g |
| (b) | Silver benzotriazole emulsion | 10 g |
| (c) | Gelatin dispersion of Dye Releasing Redox Compound (a) | 33 g |
| (d) | 5% Aqueous solution of a compound of the formula: $C_9H_{19}$—⟨benzene⟩—O—$(CH_2CH_2O)_8$—H | 5 ml |
| (e) | 10% Ethanol solution of guanidine-trichloroacetic acid | 12.5 ml |
| (f) | 10% Aqueous solution of dimethylsulfamide | 4 ml |
| (g) | Water | 7.5 ml |

The above components (a) to (g) were mixed and heated to dissolve. The resulting solution was coated on a polyethylene terephthalate film having a thickness of 180 μm in a wet thickness of 30 μm. On the thus-coated film was further coated the following composition as a protective layer:

| | | |
|---|---|---|
| (a) | 10% Aqueous solution of gelatin | 35 g |
| (b) | 10% Ethanol solution of guanidine-trichloroacetic acid | 6 ml |
| (c) | 1% Aqueous solution of sodium 2-ethylhexylsuccinate sulfonate | 4 ml |
| (d) | Water | 55 ml |

The mixture of the above components (a) to (d) was coated in a wet thickness of 25 μm, followed by drying to prepare Light-Sensitive Material E-1.

A dye fixing material was prepared as described below.

10 g of poly(methyl acrylate-co-N,N,N-trimethyl-N-vinylbenzylammonium chloride) (the molar ratio of methyl acrylate to vinylbenzylammonium chloride was 1:1) was dissolved in 200 ml of water, and the solution was uniformly mixed with 100 g of a 10% aqueous solution of lime-treated gelatin. The mixture was uniformly coated on a polyethylene terephthalate film in a wet thickness of 20 μm.

On the thus-coated film was uniformly coated a composition prepared by mixing and dissolving the following components (a) to (e) in a wet thickness of 60 μm, followed by drying to form a hydrophilic thermal solvent-containing layer:

| | | |
|---|---|---|
| (a) | Urea | 4 g |
| (b) | Water | 8 ml |
| (c) | 10% Aqueous solution of polyvinyl alcohol having a degree of polymerization of 570 and a degree of saponification of 98.5% (PVA 105, manufactured by Kuraray Co., Ltd.) | 12 g |
| (d) | 5% Aqueous solution of the compound of the formula: 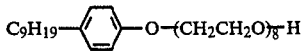 | 2 ml |
| (e) | 5% Aqueous solution of sodium dodecylbenzenesulfonate | 0.5 ml |

The thus-prepared dye fixing material is designated Dye Fixing Material R-1.

Dye Fixing Materials R-2 to 8 were prepared in the same manner as described above except for using the polymer indicated in Table 1 below as binders in place of PVA-105.

TABLE 1

| Dye Fixing Material | Polymer | Average Degree of Polymerization | Degree of Saponification (%) |
|---|---|---|---|
| R-1 | PVA-105[1] | 570 | 98.5 |
| R-2 | PVA-203[1] | 360 | 87.6 |
| R-3 | PVA-224[1] | 2,470 | 87.8 |
| R-4 | PVA-117[1] | 1,750 | 98.1 |
| R-5 | Polyvinyl alcohol (GOSESAIZA P-7100[1]) | 1,700–1,800 | 98–99 |
| R-6 | Lime treated gelatin | — | — |
| R-7 | Polyvinyl pyrrolidone | — | — |
| R-8 | Polyethylene glycol | 1,000 | — |

Note:
[1]Trade names for polyvinyl alcohol, manufactured by Kuraray Co., Ltd.
[2]A trade name for polyvinyl alcohol, manufactured by Nippon Synthetic Chemical Industry Co., Ltd.

Light-Sensitive Material E-1 was imagewise exposed at 2,000 lux for 10 seconds using a tungsten lamp. Thereafter, the sample was uniformly heated for 20 seconds on a heating block which had been heated at 140° C.

The heated light-sensitive material and each of Dye Fixing Materials R-1 to 8 were laminated together such that the coating films of the two materials faced with each other, and the laminated product was passed through heat rollers at 130° C. under pressure, and immediately thereafter, heated on a heating block heated at 120° C. for 30 seconds. Immediately after the heating, Dye Fixing Materials R-1 to 8 were peeled apart from Light-Sensitive Material E-1. A negative-working magenta color image was formed on the dye fixing material in each case. The comparative samples, i.e., Dye Fixing Materials R-6, R-7 and R-8, had a rough film surface and poor surface gloss, whereas all of Dye Fixing Materials R-1 to 5 according to the present invention had extremely excellent surface gloss.

It can be seen from these results that only polyvinyl alcohols among the hydrophilic polymers could prevent deterioration of film properties ascribed to the separation between the light-sensitive material and the dye fixing material.

EXAMPLE 2

The same procedures as described in Example 1 were repeated except that the laminate of the light-sensitive material and the dye fixing material which had been heated on a heating block was allowed to stand at room temperature for 10 minutes prior to the peeling of the dye fixing sheet.

The case of Dye Fixing Material R-6 (comparative sample), the dye fixing material adhered to the light-sensitive material too firmly to be peeled off. When it was forcedly peeled apart therefrom, the coated film of the light-sensitive material was separated from its support. Whereas, all of Dye Fixing Materials R-1 to 5 according to the present invention were easily peeled apart from the light-sensitive material and also had a good surface gloss.

EXAMPLE 3

The same procedures as described in Example 1 were repeated except that 2 g of urea and 2 g of N-methylurea were used in place of the 4 g of urea used for Dye Fixing Materials R-1 to 6, thereby to prepare Dye Fixing Materials R-9 to 14, respectively, and that Dye Fixing Materials R-9 to 14 were used in place of Dye Fixing Materials R-1 to 6 to prepare samples and to form images.

In case of using Dye Fixing Material R-14 (comparative sample) in which gelatin was used as a binder for the hydrophilic thermal solvent-containing layer, the dye fixing material on which a color image was formed had a rough film surface and poor gloss after peeling. Whereas, any of Dye Fixing Materials R-9 to 13 according to the present invention could easily be peeled apart without any damage on their film surfaces occurring and their surface gloss was very good after the peeling.

EXAMPLE 4

The same procedures as described in Example 3 were repeated except that the laminate of the light-sensitive material and the dye fixing material which had been heated on a heating block was allowed to stand at room temperature for 10 minutes prior to peeling.

In case of using Dye Fixing Material R-14 (comparative sample), since the dye fixing material adhered to the light-sensitive material too firmly to be peeled apart therefrom, when it was forcedly peeled off, the coated film of the light-sensitive material was separated from its support. Whereas, all of Dye Fixing Materials R-9 to 13 could easily be peeled apart and had good gloss on their film surfaces.

EXAMPLE 5

Light-Sensitive Material E-2 was prepared in the same manner as described for the preparation of Light-Sensitive Material E-1 in Example 1 except that the amount of guanidinetrichloroacetic acid was decreased to half the amount used in Example 1.

Light-Sensitive Material E-3 was prepared in the same manner as in Example 1 except that guanidinetrichloroacetic acid was not used.

Further, Dye Fixing Materials R-15 to 20 were prepared in the same manner as described for the preparation of Dye Fixing Materials R-9 to 14, respectively, except that 0.4 g of guanidinetrichloroacetic acid was added to the coating solution. Similarly, Dye Fixing Materials R-21 to 26 were prepared in the same manner as described for the preparation of Dye Fixing Materials R-9 to 14, respectively, except that 0.8 g of guanidinetrichloroacetic acid was added to the coating solution.

Light-Sensitive Materials E-2 and E-3 were imagewise exposed at 2,000 lux for 10 seconds using a tungsten lamp, and then intimately laminated with each of Dye Fixing Materials R-15 to 20 and each of Dye Fixing Materials R-21 to 26, respectively, such that the coating films of each of the two materials faced to each other. The laminated product was pressed between heat rollers set at 130° C. Immediately after the heating, the dye fixing material was peeled apart from the light-sensitive material. A magenta color image was formed on the dye fixing material in each case, but in the cases of using Dye Fixing Materials R-20 and 26 (comparative samples) in which gelatin was used as a binder of a dye transfer aid layer, the film surface of the dye fixing layer having thereon a color image was rough after peeling and had a poor surface gloss. Whereas, Dye Fixing Materials R-15 to 19 and R-21 to 25 according to the present invention could easily be peeled apart from the light-sensitive material without roughness on their film surfaces occurring and had very good surface gloss.

EXAMPLE 6

The same procedures as described in Example 5 were repeated except that the laminates of the light-sensitive material and the dye fixing material after heated on a heating block were allowed to stand at room temperature for 10 minutes prior to peeling apart.

In the cases of using Dye Fixing Materials R-20 and 26 (comparative samples), the dye fixing materials adhered to the light-sensitive materials too firmly to be peeled apart therefrom, and forced peeling caused separation of the coating layer of the light-sensitive material from its support. To the contrary, Dye Fixing Materials R-15 to 19 and R-21 to 25 could easily be separated from the light-sensitive materials and had good surface gloss after the separation.

While the invention has been described in detail and with reference to specific embodiments thereof, it will be apparent to one skilled in the art that various changes and modifications can be made therein without departing from the spirit and scope thereof.

What is claimed is:

1. In a process for forming a color image comprising exposing and heating in the presence of a hydrophilic thermal solvent a light-sensitive material comprising a support having thereon a light-sensitive silver halide, a hydrophilic binder and a compound capable of forming or releasing a hydrophilic mobile dye chemically in connection with reduction of the silver halide into silver upon heating, transferring and fixing through the use of only said heating and hydrophilic thermal solvent the thus formed or released hydrophilic dye to a dye fixing layer having a hydrophilic binder, and then separating the portion having the silver halide and the compound capable of forming or releasing a hydrophilic mobile dye and the portion having the dye fixing layer from each other, and wherein to improve separability when the portion having the silver halide is separated from the portion having the dye fixing layer polyvinyl alcohol having a degree of saponification of not less than about 70% is present in at least one surface layer of the light-sensitive material and the dye fixing layer being separated.

2. The process as claimed in claim 1, wherein the polyvinyl alcohol is present in a surface layer in the dye fixing layer.

3. The process as claimed in claim 1, wherein the polyvinyl alcohol is present in an amount of not less than 50% by weight based on the weight of the polyvinyl alcohol-containing coating.

4. The process as claimed in claim 1, wherein the polyvinyl alcohol is present in an amount of not less than about 75% by weight based on the weight of the layer containing the polyvinyl alcohol.

5. The process as claimed in claim 1, wherein the polyvinyl alcohol-containing surface layer has a thickness of at least 0.1$\mu$.

6. The process as claimed in claim 5, wherein the polyvinyl alcohol-containing surface layer has a thickness of at least 0.5$\mu$.

7. The process as claimed in claim 1, wherein the polyvinyl alcohol has a degree of saponification of not less than about 70% and a degree of polymerization of about 300 to 2,000.

8. The process as claimed in claim 7, wherein the polyvinyl alcohol has a degree of saponification of not less than 80%.

9. The process as claimed in claim 1, wherein the formed or released mobile dye is transferred at high temperatures of about 60° C. or more.

10. The process as claimed in claim 9, wherein the mobile dye is transferred by heating.

11. The process as claimed in claim 1, wherein said dye fixing layer comprises a mordant and gelatin or a gelatin derivative.

* * * * *